United States Patent [19]

MacKay, Jr.

[11] Patent Number: 5,031,361

[45] **Date of Patent: * Jul. 16, 1991**

[54] DISPOSABLE FINISHING ARTICLE HAVING INTEGRAL MOUNTING HUB INCLUDING IMPROVED METAL PRESSURE CAP

[76] Inventor: Joseph H. MacKay, Jr., 17551 Cabela Dr., San Diego, Calif. 92127

[ * ] Notice: The portion of the term of this patent subsequent to Jul. 5, 2005 has been disclaimed.

[21] Appl. No.: 543,289

[22] Filed: Jun. 25, 1990

Related U.S. Application Data

[63] Continuation-in-part of Ser. No. 355,213, May 22, 1989, Pat. No. 4,979,336, which is a continuation-in-part of Ser. No. 212,448, Jun. 28, 1988, Pat. No. 4,924,634, which is a continuation-in-part of Ser. No. 5,812, Jan. 21, 1987, Pat. No. 4,760,670, which is a continuation-in-part of Ser. No. 847,793, Apr. 3, 1986, Pat. No. 4,694,615.

[51] Int. Cl.[5] ..... B24B 45/00

[52] U.S. Cl. ..... 51/168; 51/209 R; 51/378

[58] Field of Search ..... 51/168, 378, 376, 358, 51/377, 389, 209 R; 15/230.18, 230.19

[56] References Cited

U.S. PATENT DOCUMENTS 2,439,751 4/1948 Olsen ..... 51/379

4,694,615 9/1987 MacKay, Jr. ..... 51/209 R 4,754,577 7/1988 MacKay, Jr. ..... 51/168

*Primary Examiner*—Robert A. Rose

*Attorney, Agent, or Firm*—Nilsson, Robbins, Dalgarn, Berliner, Carson & Wurst

[57] ABSTRACT

A disposable finishing article for mounting on a rotatable threaded spindle of a power tool. The finishing article contains a retaining nut on one side and a backing member on the other side non-removably secured together on the finishing article without the aid of adhesives in such a manner that the finishing article is placed in compression when it is operably secured upon the spindle of the power tool under operative loads. The backing member includes an inner annular portion defining a platform surrounding the nut and having one surface resting upon the other side of the finishing article. The nut and backing member are secured together by upsetting one end of the nut causing it to protrude outwardly over the outer surface of the flange. A metal pressure cap is secured to the backing member for engaging a shoulder formed on the spindle of the power tool during operation of the finishing article. The metal pressure cap includes a base and a top with the base having an outwardly directed flange which seats upon the platform. The backing member is upset to secure the pressure cap and backing member together.

12 Claims, 2 Drawing Sheets

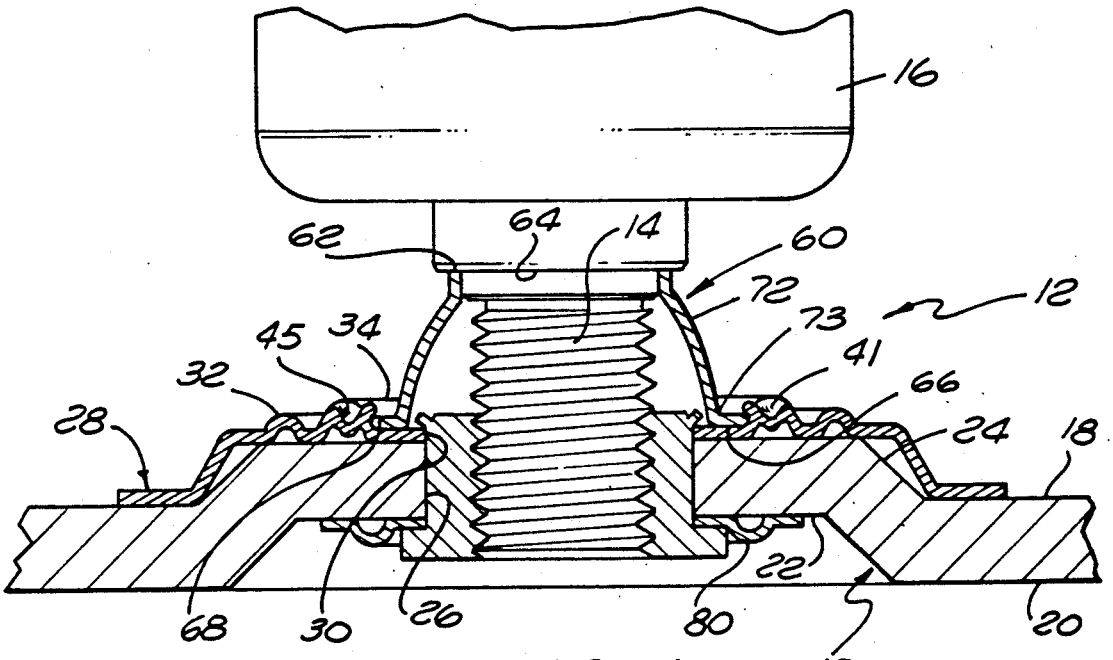
FIG. 1
FIG. 3
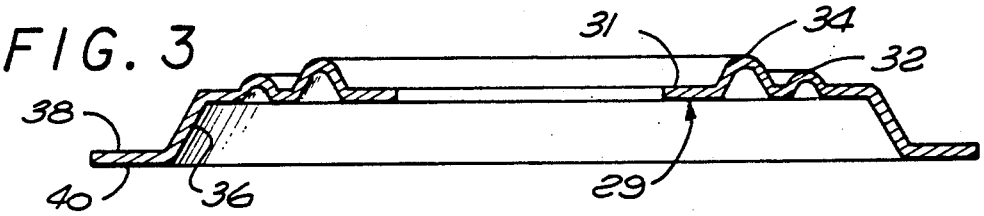
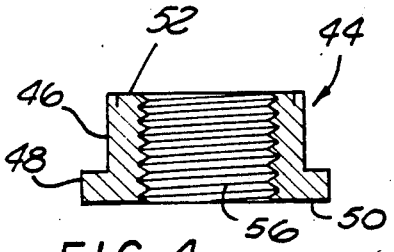
FIG. 4
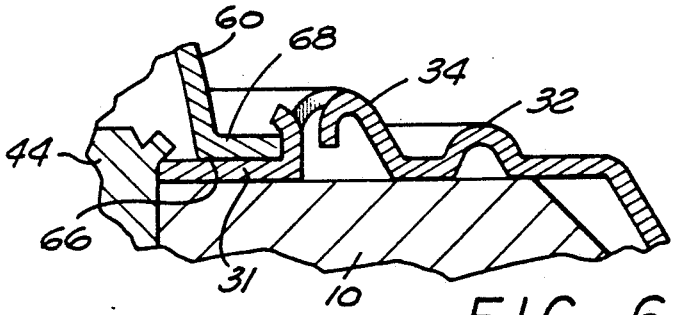
FIG. 6
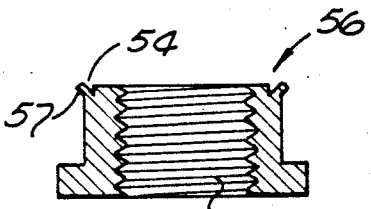
FIG. 5
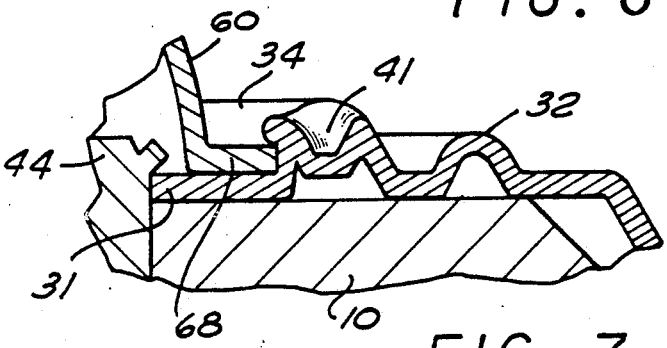
FIG. 7

DISPOSABLE FINISHING ARTICLE HAVING INTEGRAL MOUNTING HUB INCLUDING IMPROVED METAL PRESSURE CAP

RELATED APPLICATION

This application is a continuation-in-part of U.S. patent application Ser. No. 355,213 filed May 22, 1989, for DISPOSABLE FINISHING ARTICLE HAVING AN INTEGRAL MOUNTING HUB INCLUDING AN IMPROVED METAL PRESSURE CAP now U.S. Pat. No. 4,979,336 which is a continuation-in-part of U.S. patent application Ser. No. 212,448 filed June 28, 1988, for FINISHING ARTICLE HAVING AN INTEGRAL MOUNTING HUB AND IMPROVED BASE now U.S. Pat. No. 4,924,634 which is a continuation-in-part of U.S. patent application Ser. No. 005,812, filed Jan. 21, 1987, for DISPOSABLE DEPRESSED CENTER GRINDING WHEEL HAVING AN INTEGRAL MOUNTING HUB, now U.S. Pat. No. 4,760,670 which is a continuation-in-part of U.S. patent application Ser. No. 847,793, filed Apr. 3, 1986, for DISPOSABLE DEPRESSED CENTER GRINDING WHEEL HAVING AN INTEGRAL MOUNTING HUB, now U.S. Pat. No. 4,694,615.

FIELD OF THE INVENTION

This invention relates generally to finishing articles and more particularly to such articles having a mounting hub permanently affixed thereto with the combination adapted for quick attachment and release to an appropriate portable power tool. The finishing article may be disposed of when spent.

BACKGROUND OF THE INVENTION

The use of rotatably driven finishing articles is widespread and familiar in our industrial society. One of the more serious problems encountered in the use of such devices resides in the provision of effective means for preventing undesired or accidental disassociation of the article from the shaft, spindle or other rotatable drive means on which it is mounted. This problem is particularly acute when the connection between the article and its driving shaft or spindle is intentionally detachable to facilitate quick removal and replacement of the article. Into this category fall a host of devices, for example, portable powered grinders wherein the grinding wheels employed are intentionally detachable from the power driven shaft so that they may be readily replaced. To properly mount the grinding wheel upon the shaft provision must be made to provide sufficient clamping force and also to secure the wheel rotationally.

One means of securing the grinding wheel to the drive shaft has been to provide an appropriate backing flange with a central opening which is aligned with an opening provided in the depressed center abrasive grinding wheel. A bolt or nut member (depending upon the configuration of the drive shaft, that is, whether it is externally or internally threaded) is inserted from the face side of the grinding wheel and is then tightened in place. In this manner a plurality of loose parts are configured in a completed assembly ready for use. As the grinding wheel is utilized the appropriate clamping force is provided to securely affix the grinding wheel to the drive shaft. Such an assembly, however, typically requires appropriate tools such as wrenches or the like to remove the grinding wheel from the drive shaft. Such a device is shown in U.S. Pat. Nos. 489,149; 3,596,415; 1,998,919; 566,883; 507,223; 1,162,970; 791,159; 489,149 and 3,210,892.

Subsequently it became desirable to affix the mounting hub permanently to the grinding wheel so that the entire unit may be quickly and easily attached and detached from the drive shaft and discarded when the grinding wheel has been worn down. In these types of devices it is customary to utilize an adhesive such as an epoxy resin or the like between the backing flange and the back surface of the grinding wheel to retain integrity between the mounting hub and the grinding wheel to secure the wheel rotationally.

Even though the adhesive tended to work quite well in most applications, it was discovered that in some instances the adhesive would break loose and the grinding wheel would rotate relative to the mounting hub. Such was particularly the case since the hub was a one-piece member which was internally threaded and held in place upon the grinding wheel by swaging an extension thereof into place, thus providing a fixed clamping force holding the grinding wheel. No additional clamping force was exerted during further rotation of the wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel. Examples of such devices are shown in U.S. Pat. Nos. 3,136,100; 4,015,371; 2,278,301; 3,081,584; 3,500,592; 3,800,483; 4,240,230 and 4,541,205.

Additional prior art patents known to applicant are U.S. Pat. Nos. 3,041,797; 3,879,178; 1,724,742; 3,912,411; 3,879,178; 3,960,516; 4,026,074; 4,054,425; 4,088,729; 4,322,920; 4,439,953; 4,449,329; 4,601,661; 791,791; 872,932; 2,567,782; 3,136,100, 3,210,892 and 3,621,621.

The devices utilized in the prior art for providing the disposable finishing article assembly including the permanent affixed mounting hub generally provide the service intended. There are certain inherent disadvantages found with regard to the various devices. Such disadvantages are that in manufacturing the utilization of an adhesive adds additional labor to the cost of manufacturing. In certain of the devices, parts must be keyed together and properly aligned in order to function appropriately. In addition thereto, through the utilization of die-cast mounting hubs which include as an integral part the backing flange there is no additional clamping force exerted upon the finishing article as it is being rotated by the power tool. Furthermore, such die-cast mounting hubs are relatively bulky, take up space and add substantial weight and additional cost to the completed product.

SUMMARY OF THE INVENTION

A finishing article having a drive member nonremovably affixed thereto for mounting on a rotatable spindle of a power tool. The drive member includes a backing member having a platform surrounding a central opening therethrough secured by a retaining nut positioned on the opposite side from the backing member. The platform rests upon the finishing article. The retaining nut extends through an opening in the finishing article from the face toward the back of the finishing article and has a radial flange at one end thereof seated against the finishing article face and protrusion means extending outwardly from the other end thereof for non-removably securing the retaining nut and the backing member together on the finishing article without the use of adhesives. A truncated conically shaped metal pressure cap defining a central opening has a base and a top and is held in place by upsetting the backing member. The base of the pressure cap includes an outwardly protruding flange which is seated upon the platform. The pressure cap extends longitudinally away from the backing member for the top to engage the power tool spindle seat for placing the finishing article in compression during use thereof when the finishing article is operatively secured upon the spindle of the power tool.

In accordance with a more specific aspect of the present invention, there is provided a washer like member disposed between the front surface of the finishing article and the radial flange on the retaining nut which functions as a center reinforcing flange. The washer like member provides a wider distribution of stresses generated during operation of the finishing article and particularly for large diameter grinding wheels where stresses may be sufficiently large enough under certain operating circumstances to pull the retaining nut through the grinding wheel.

BRIEF DESCRIPTION OF THE DRAWINGS

FIG. 1 is a cross sectional view of a finishing article assembly constructed in accordance with the principles of the present invention and mounted in operable position on the spindle of a power tool;

FIG. 3 is a cross sectional view taken about the lines 3—3 in FIG. 2 of a backing flange constructed in accordance with the present invention;

FIG. 4 is a cross sectional view of a retaining nut constructed in accordance with the principles of the present invention;

FIG. 5 is a cross sectional view of the retaining nut of FIG. 5 after being upset;

FIG. 6 is an enlarged fragmentary cross sectional view illustrating one way for securing the pressure cap to the baking member; and FIG. 7 is another enlarged fragmentary cross sectional view illustrating a preferred embodiment for attaching the pressure cap to the backing member.

DETAILED DESCRIPTION

Figure 2:
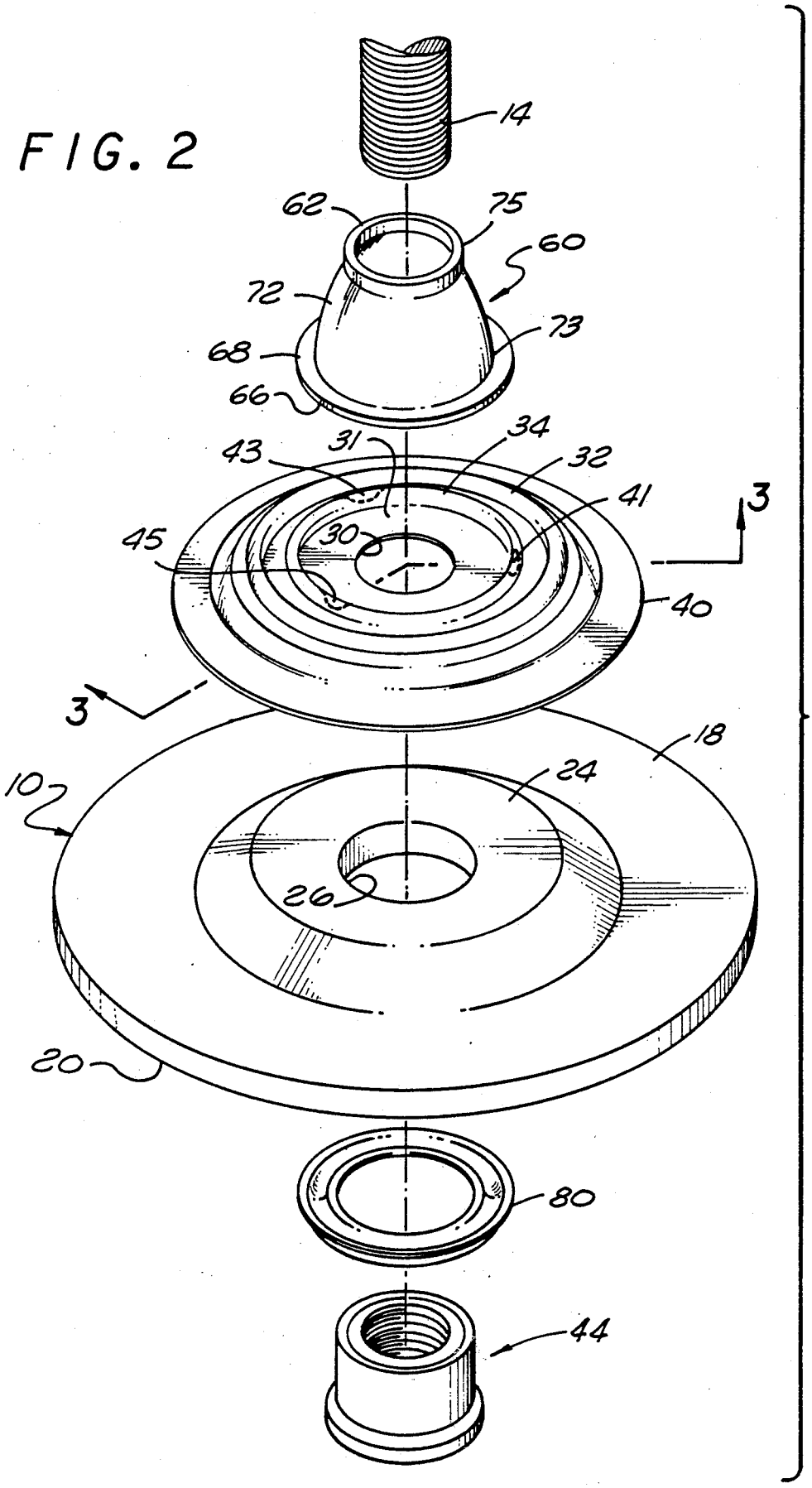
FIG. 2 is an exploded view of the structure as illustrated in FIG. 1.

By reference now to FIGS. 1 through 7, there is illustrated a preferred embodiment of a disposable finishing article drive member assembly constructed in accordance with the principles of the present invention. The finishing article constructed in accordance with the present invention may take many forms, such, for example, as grinding wheels, flap wheels, wire wheels, abrasive disks or pads, or the like. For purposes of ease of illustration and clarity of description only a depressed center grinding wheel will be shown and described. It will, however, be understood by those skilled in the art that other disposable finishing articles which may be placed in compression during use thereof may be substituted for the grinding wheel. As is shown in FIGS. 1 through 7, a depressed center grinding wheel 10 has a disposable drive member or hub assembly 12 permanently affixed thereto without the use of adhesives so that the grinding wheel may be attached to the threaded spindle 14 of an appropriate power tool 16. According to the principles of the present invention, a disposable mounting hub or drive member is constructed in such a manner that when the grinding wheel is placed in operation upon the spindle 14 the grinding wheel 10 is placed in compression and the more force that is applied to the grinding wheel during utilization thereof, the greater the operational compression becomes. As a result of placing the grinding wheel in such compression the grinding wheel is maintained upon the spindle and at the same time, through the compression or clamping force, the grinding wheel 10 cannot rotate relative to the drive member or hub assembly 12. However, as a result of the construction of the drive member, the spent grinding wheel may be easily removed from the spindle for disposal without the utilization of hand tools or the like.

As is clearly shown, the grinding wheel 10 includes a back surface 18 and a front surface 20. The central portion of the grinding wheel is depressed as viewed from the front thereof and as is shown at 22, with a corresponding central raised portion 24 on the back thereof. A centrally located aperture 26 is provided in the depressed center portion of the grinding wheel 10. The purpose of the depressed center of the grinding wheel 10 is to insure that the driving member or spindle does not protrude beyond the face portion 20 of the wheel 10 and thus interfere with a workpiece during the time grinding wheel 10 is being utilized. However, when certain types of finishing articles are utilized such that the outer circumference is used instead of the face, then a depressed center may not be necessary or included in the article.

A backing member 28 is provided and is adapted to be snugly received on the back surface 18 of the grinding wheel 10 about the raised portion 24. The backing member 28 has a diameter which is less than the diameter of the wheel 10. The backing member 28 defines a second central aperture 30 therethrough which is aligned with the aperture 26 in the grinding wheel 10. The backing member 28 includes an inner annular portion 29 defining a platform 31. Reinforcing ribs 32 and 34 are formed in the backing member 28 concentrically with the opening 30. The backing member 28 is preferably stamped from sheet metal.

As is shown more specifically in FIG. 3, the backing member 28 member 28 includes an inner surface 36 and an outer surface 38. The inner surface 36 is disposed opposed the back surface 18 of the abrasive finishing wheel 10. The inner surface 36 includes a land 40. The land 40 is formed about the outer peripheral portion of the backing member 28. The land 40 always engages the back surface 18 of the abrasive finishing wheel away from the depressed center. The inner surface 36 at the platform 31 engages the back surface of the abrasive finishing wheel 10 surrounding the central aperture therein.

As can be seen, particularly in FIGS. 2 and 3, the ribs 32 and 34 formed in the outer surface 38 of the backing member 28 are continuous. The continuous rib 32 is disposed adjacent the land 40 and is disposed over the transitional area between the depressed center and the remainder of the grinding wheel 10 while the continuous rib 34 is disposed intermediate the opening 30 and the land 40.

As shown in FIG. 4, a retainer nut 44 includes a body portion 46 which is hollow and has a radially outwardly extending flange 48 at a first end 50 thereof. The internal surface of the body 46 has threads 56 formed there-along for attachment to the threaded spindle 14 of the power tool. The nut 44 is inserted through the aperture 26 in the grinding wheel and the aperture 30 in the backing member 28 from the front surface 20 toward the rear surface 18 of the grinding wheel 10. The end 52 of the nut 44 extends through the opening 30 in the backing member 28.

The nut 44 is preferably constructed from a metal die casting but may be formed from an aluminum extrusion which is then machined to provide the flange 48 and the threads 46. Alternatively the nut may be formed from steel bar stock, molded plastic or formed by cold heading.

Once the nut 44 has been inserted through the openings in the wheel 10 and the backing member 28, the end 52 thereof is upset such as by a staking operation to provide a protrusion 56 extending outwardly therefrom as shown specifically in FIG. 5. The protrusion may be formed as a series of separate protrusions, or, as shown, as a continuous protrusion. Preferably the protrusion is formed by a staking operation which forms a continuous groove 54 in the end of 52 of the nut 44. Formation of the groove 54 causes the displaced material to form a lip or overhang 57 which will overlie the back of the backing flange 28 about the opening 30 therethrough. It should become apparent to those skilled in the art that the flange 28 and the nut 44 are secured together on the wheel 10 between the flange 48 and the overhang 57 without the use of adhesives.

To provide proper operational compressive forces of the disposable grinding wheel as above-described, a pressure cap 60 is held in engagement with the hub assembly 12. The metal pressure cap 60 is formed as a truncated conically shaped member having a hollow body 72, a base 73 and a top 75. A radially outwardly extending flange 68 is formed at the base 73 of the frusto conically shaped pressure cap. Preferably the metal pressure cap 60 is formed from sheet metal using progressive dies, however, it will be recognized that the frusto conical body 72 may be formed by metal die casting as well. The metal pressure cap 60 includes a first or rear surface 62 for engaging a surface 64 on the power tool spindle when the grinding wheel is in an operable position on the power tool 16. A second or front surface 66 on the metal pressure cap flange 60 rests upon the top surface 38 at the platform 31 and seats within the depression or cavity formed by the rib 34 in such a manner that the outer periphery of the flange 68 is disposed adjacent the inner most edge of the rib 34. The metal pressure cap 60 is retained in position on the backing member 28 by upsetting the continuous rib 34 so that it engages the flange 68 about its periphery. Once installed, the metal pressure cap 60 remains on the grinding wheel 10 and is disposed of along with the spent wheel 10. The hollow body 72 of the metal pressure cap 60 defines an aperture 61 for receiving the spindle 14 of the power tool. When assembled on the backing member 28 the apertures 26, 30 and 61 are aligned axially.

As is illustrated particularly in FIGS. 1, 6 and 7, the pressure cap 60 is retained on the backing member 28 by upsetting the continuous rib 34 at a plurality of points 41, 43 and 45. Although three points are illustrated, it should be recognized that three is a minimum in number and it has been found that six points of upset equal angularly disposed are preferable for most applications. After the upsetting operation, the cap 60 may be loosely retained or may be substantially immovable, the critical factor is that the cap 60 is non-removably retained on the backing member 28. Preferably, the upsetting operation is done by a blunt nosed punch type tool which deforms the points 41, 43 and 45 without penetrating through the backing member 28. This is shown more clearly in FIG. 7. As is therein shown, the deformation 41 spreads the adjacent material of the rib 34 outwardly so that it overlaps the periphery of the flange 68 and traps the flange 68 against the platform 31. At least three such deformations will non-removably secure the pressure cap 60. As is more clearly shown in FIG. 6, the upsetting operation may penetrate through the rib 32 and provide a small tongue like protrusion which is caused to overlap the periphery of the flange 68. In either event the pressure cap is non-removably secured to the backing member 28 with the bottom surface 66 of the flange 68 seated upon the platform 31.

As will be noted, when the grinding wheel is in use on the power tool compressive forces are transmitted in a substantially straight line along a plane formed through the side wall of the body 72 of the pressure cap 60 between the surfaces 62 and 66. It is particularly noteworthy that there are no curved surfaces where deformation may occur by unusually large forces created during grinding.

The force necessary to cause the grinding wheel 10 to be placed in compression is generated upon attachment of the spindle 14 to the threads 56 in the nut 44. By reference to FIG. 1 it will be noted that when the grinding wheel is threaded upon the spindle 14 the surface 62 engages the spindle seat 64. The interengagement between the threads 14 and 56 of the spindle and nut, respectively, urge the nut upward toward the flange 28 as the wheel is seated upon the spindle. At the same time, the spindle seat 64 applies a downward force to surface 62 of the pressure cap 60 which in turn, through the surface 66 applies a downward force to the flange 28. Therefore, this mutual clamping force causes the grinding wheel to be placed in compression. Those skilled in the art will recognize that as the grinding wheel 10 is used by being placed against a workpiece, additional torque is applied causing the grinding wheel to be further tightened onto the spindle 14. That is, if the grinding wheel moves, even incrementally, during contact with a workpiece, the friction between the nut and the grinding wheel center causes the nut to rotate in a further tightening direction. Such rotation of the nut further urges the nut toward the flange which in turn applies a further force to the flange. The more the grinding wheel is tightened the greater the operational compression force becomes and the more securely the grinding wheel 10 is clamped between the backing flange 28 and the flange 48 on the nut 44. As a result of this strong clamping or compression the grinding wheel 10 is precluded from movement relative to the hub or driving member 12 and at the same time is precluded from disengaging from the spindle 14. It will be recognized by those skilled in the art that the grinding wheel assemblies as illustrated in FIGS. 1 through 7 and as above described require no adhesive for construction and may be simply and easily assembled, are relatively light in weight as compared to the prior art devices utilizing the cast hubs and provides a secure attachment of the abrasive finishing article to the power tool and through the utilization of the increased compression precludes relative rotation of the grinding wheel with respect to the driving member. It has also been discovered that the utilization of the device as above described and as constructed in the preferred embodiment is extremely smooth in operation with no vibration. The reason for such extremely smooth operation is that all of the parts are perfectly aligned one with the other with the abutting surfaces parallel when in compression and only the wheel 10 can cause any vibration and then only if it is not properly balanced during the construction thereof.

Because of the extreme forces generated particularly with large grinding wheels, it has been found that a washer like member 80 disposed between the flange 48 on the nut 44 and the grinding wheel 10 functions to distribute the forces over a wider portion of the wheel 10.

Through the structures as illustrated and described, all currently known sizes of standard diameter depressed center grinding wheels, namely four inch, four and one half inch, five inch, seven inch and nine inch may be accommodated. At the present time, through the utilization of the die-cast integral hub-flange structure, only seven and nine inch grinding wheels utilize the throw away hub while the four, four and one half and five inch wheel utilize the conventional two-piece mounting set traditional in the prior art and as above described.

There has thus been disclosed a disposable finishing article driving member assembly which securely holds the article during operation, which is light in weight, vibration-free, and less expensive than prior art throw-away articles while meeting all safety standards currently known and in existence.

What is claimed is:

1. A finishing article having a disposable drive member non-removably affixed thereto for mounting on a threaded rotatable spindle of a power tool comprising:

a finishing article having a face and a back and having a first centrally disposed aperture therethrough;

a backing member having an inner and outer surface and diameter smaller than the diameter of said finishing article, said backing member defining a second centrally disposed aperture therethrough, and a platform surrounding said second opening with said inner surface at said platform engaging said back of said finishing article, said first and second apertures being aligned;

a retaining nut having a hollow internally threaded body having first and second ends and a first radially outwardly extending flange extending from said first end of said body, said body extending through said first and second apertures from said face toward said back with said radial flange seated against said face; and means protruding outwardly from said second end of said body to non-removably secure said retaining nut and said backing flange together on said wheel without the use of adhesives;

a metal pressure cap defining a centrally disposed opening therethrough and having second radially outwardly extending flange, said second flange being seated on said platform; and means on said backing member for non-removably securing said pressure cap on said platform to apply force to said backing member when said finishing article is secured on said spindle to cause said backing member and said retaining nut to move toward each other to compress said finishing article therebetween as operative loads are applied to said finishing article during use on said power tool.

2. A finishing article as defined in claim 1 wherein said metal pressure cap further includes a cap body having a frusto conical shape with said flange extending radially outwardly from a base thereof.

3. A finishing article as defined in claim 2 wherein said outer surface of said backing member includes a reinforcing rib and surrounding said platform extending therefrom and wherein said second flange of said metal pressure cap includes a periphery disposed adjacent said reinforcing rib.

4. A finishing article as defined in claim 3 wherein said cap body includes a side wall defining a substantially straight plane between said first and second surfaces along which said force is applied.

5. A finishing article as defined in claim 3 wherein said reinforcing rib on said backing member is deformed to secure said second flange on said platform.

6. A finishing article as defined in claim 5 wherein said reinforcing rib is deformed by upsetting at a plurality of angularly spaced points.

7. A finishing article as defined in claim 6 wherein said upsetting spreads said reinforcing rib at each of said plurality of points so that said reinforcing rib overlaps said periphery of said second flange at each said point.

8. A finishing article as defined in claim 7 wherein said reinforcing rib is not pierced by said upsetting.

9. A finishing article as defined in claim 7 wherein said reinforcing rib reinforcing rib is pierced by said upsetting.

10. A finishing article as defined in claim 7 wherein said reinforcing rib is annular and continuous and extends from said outer surface of said backing member a distance sufficient to be above said second flange on said pressure cap.

11. A finishing article as defined in claim 1 which further includes a washer like member disposed between said first flange on said retaining nut and said face of said finishing article.

12. A finishing article as defined in claim 11 wherein said washer like member includes a second reinforcing rib formed therein and surrounding said first flange on said retaining nut.

* * * * *